US008959671B1

(12) United States Patent
Mandak

(10) Patent No.: US 8,959,671 B1
(45) Date of Patent: Feb. 24, 2015

(54) APPARATUS AND METHODS FOR PREVENTING COMMOTIO CORDIS AND OTHER TRAUMATIC CHEST AND BODILY INJURIES

(71) Applicant: Jeffrey S. Mandak, Enola, PA (US)

(72) Inventor: Jeffrey S. Mandak, Enola, PA (US)

(73) Assignee: Jeffrey S. Mandak, Enola, PA (US)

( * ) Notice: Subject to any disclaimer, the term of this patent is extended or adjusted under 35 U.S.C. 154(b) by 0 days.

(21) Appl. No.: 14/028,001

(22) Filed: Sep. 16, 2013

Related U.S. Application Data

(60) Provisional application No. 61/700,978, filed on Sep. 14, 2012.

(51) Int. Cl.

| | |
|---|---|
| ***A41D 13/015*** | (2006.01) |
| ***A63B 71/12*** | (2006.01) |
| ***A41D 13/05*** | (2006.01) |
| *A41D 13/00* | (2006.01) |

(52) U.S. Cl.
CPC ..... *A41D 13/0518* (2013.01)
USPC ..... 2/463; 2/455; 2/464

(58) Field of Classification Search
CPC ..... A41D 13/0518; A41D 13/065; A41D 13/0153; A63B 2071/1208; A63B 71/12; A63B 2071/125; A63B 71/081; A63B 71/1225; A63B 2071/1233; A63B 2208/12; A42B 3/20
USPC ..... 2/455, 456, 463, 464, 467, 410, 424, 2/425, 24, 92, 267, 913
See application file for complete search history.

(56) References Cited

U.S. PATENT DOCUMENTS

| | | | | |
|---|---|---|---|---|
| 3,041,623 | A * | 7/1962 | Glahe | 2/9 |
| 4,441,211 | A * | 4/1984 | Donzis | 2/459 |
| 5,950,249 | A * | 9/1999 | Clement | 2/463 |
| 7,237,270 | B2 * | 7/2007 | Crye et al. | 2/24 |
| 7,260,854 | B2 * | 8/2007 | Hahn et al. | 2/431 |
| 7,376,978 | B2 * | 5/2008 | Godshaw | 2/24 |
| 7,430,763 | B1 * | 10/2008 | Santos | 2/9 |
| 7,445,541 | B2 * | 11/2008 | Patterson | 450/54 |
| 7,448,088 | B2 * | 11/2008 | Miller | 2/24 |
| 7,451,493 | B2 * | 11/2008 | Godshaw | 2/24 |
| 7,503,080 | B2 * | 3/2009 | Link | 2/463 |
| 7,735,161 | B2 * | 6/2010 | Purington | 2/463 |
| 7,765,615 | B2 * | 8/2010 | Eastwood et al. | 2/115 |
| 7,877,820 | B2 * | 2/2011 | Landi et al. | 2/463 |
| 8,220,079 | B2 * | 7/2012 | Syska et al. | 2/463 |
| 2005/0251901 | A1 * | 11/2005 | Link | 2/462 |
| 2006/0005306 | A1 * | 1/2006 | Call et al. | 2/463 |
| 2007/0136935 | A1 * | 6/2007 | Purington | 2/463 |
| 2008/0178371 | A1 * | 7/2008 | Landi et al. | 2/463 |
| 2008/0235855 | A1 * | 10/2008 | Kobren et al. | 2/463 |

OTHER PUBLICATIONS

Document showing examples of commercially-available products that are believed to have been on sale at least one year prior to Sep. 14, 2012.

* cited by examiner

*Primary Examiner* — Bobby Muromoto, Jr.
(74) *Attorney, Agent, or Firm* — Design IP

(57) ABSTRACT

A protective device and methods for protecting a selected portion of a mammal's body from an impact is disclosed. In some embodiments, the protective device is placed adjacent to or in close proximity to the selected portion of the mammal's body, and the protective device acts to reflect, deflect, and/or otherwise divert impact energy that has been transferred to the protective device to areas of the mammal's body that are not within the selected portion thereof.

20 Claims, 11 Drawing Sheets

APPARATUS AND METHODS FOR PREVENTING COMMOTIO CORDIS AND OTHER TRAUMATIC CHEST AND BODILY INJURIES

RELATED APPLICATIONS

This application claims priority to U.S. provisional application No. 61/700,978, filed Sep. 14, 2012 the contents of which are incorporated herein by reference.

FIELD OF THE INVENTION

The present invention relates to protective apparel and apparatuses, including for athletic activities that involve collisions and include moving projectiles.

BACKGROUND OF THE INVENTION

Recent studies have identified that blows to the torso in the vicinity of the heart—which may lead to commotio cordis, in which the heart rhythm is disrupted—are a leading cause of death in young athletes. Commotio cordis is an etiology of ventricular fibrillation (commonly referred to as "V-Fib" or "VF") that occurs as a result of a blow to the torso area directly over the heart at a specific time during the normal sinus rhythm of a heart (specifically, during a portion of the ascending phase of the T wave). Most events of commotio cordis are caused by blows from projectiles such as lacrosse balls, baseballs, and hockey pucks, though blows from other collisions with objects or persons may also cause commotio cordis, thereby potentially leading to severe injury or death. In response to this hazard, many companies have developed chest protective equipment that these companies claim protect athletes from harm. Unfortunately, none of the best-selling available equipment prevents commotio cordis in the most advanced animal study performed to date. See FAILURE OF COMMERCIALLY AVAILABLE CHEST WALL PROTECTORS TO PREVENT SUDDEN CARDIAC DEATH INDUCED BY CHEST WALL BLOWS IN AN EXPERIMENTAL MODEL OF COMMOTIO CORDIS, Pediatrics (Official Journal of the American Academy of Pediatrics) 2006; 117; e656, by Weinstock et al., originally published online Mar. 1, 2006 (hereinafter the "Pediatrics Study"), which is incorporated herein by reference as if set forth in its entirety.

Existing chest protectors are composed of one or more compliant layer(s) of closed-cell foam or sleeves of expanded polypropylene beads that lie against the precordium and are intended to dissipate the energy of impact over a greater surface area, thus representing the prevailing view that foam, cushion, and beads are necessary to prevent the energy of a projectile or other blow to the chest wall from causing commotio cordis by spreading out over a larger area and thus dissipating the energy of an impact. As evidenced by the results of the Pediatric Study, this is not the correct approach to preventing instances of commotio cordis.

Accordingly, there is a need for an apparatus and methods for preventing commotio cordis and other traumatic chest and bodily injuries that overcome the limitations and drawbacks of the prior art.

BRIEF DESCRIPTION OF THE DRAWINGS

The foregoing summary, as well as the following detailed description of the invention, will be better understood when read in conjunction with the appended drawings. For the purpose of illustrating the invention disclosed herein, certain embodiments in accordance with the herein disclosed invention are shown in the drawings. It should be understood, however, that the herein disclosed invention is not limited to the precise arrangements shown. It should also be understood that, in the drawings, the parts are not necessarily drawn to scale. The present invention will hereinafter be described in conjunction with the appended drawing figures, wherein like numerals denote like elements. In the drawings.

SUMMARY OF THE INVENTION

Figure 1:
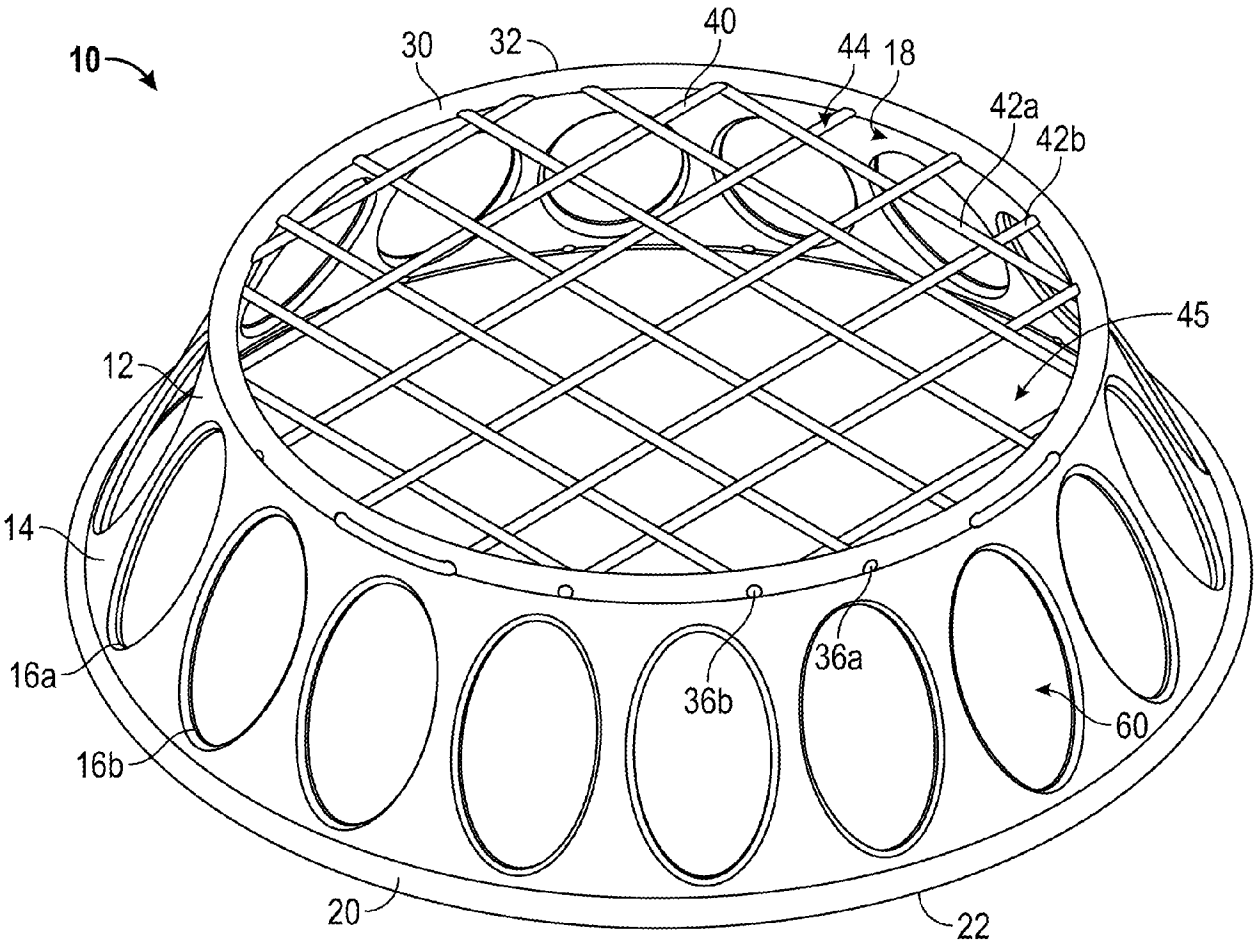
FIG. 1 is a perspective view of a first embodiment of a device according to the present invention.

Provided herein are a novel and non-obvious apparatus and associated methods for protecting a mammal's body from injury that would otherwise result from a collision with an object or the impact of a projectile with a portion of the user's body. As noted above, blows to the torso in the vicinity of the heart—which may lead to commotio cordis, in which the heart rhythm is disrupted—are a leading cause of death in young athletes. The device and methods according to the present application seek to reduce or eliminate instances of commotio cordis by providing means and methods to reflect, deflect, and/or otherwise divert the impact energy away from a specific portion of the mammal. When placed in front of the cardio silhouette of a mammal, for example, the protective device according to this application would reflect, deflect, and/or otherwise divert the energy caused by impact of an object with the device (hereinafter the "impact energy") around the cardiac silhouette. Accordingly, the impact energy is not transferred to the mammal's heart.

In this application, Applicant discusses in detail embodiments of the protective device that are intended to be located in front of the cardiac silhouette of a mammal. It should be understood that the inventive concepts discussed herein have equal application for the protection of other portions of a mammal's body, for example the face, throat, or groin, mutatis mutandis.

In some embodiments described herein, the protective device includes tensioned members, such as tensioned textiles, strings, wires, bands, and/or support struts that are mounted onto a frame which has been appropriately configured, sized, and shaped in order to cover and conform to the area of the mammal that is to be protected, regardless of the body and limb position of the mammal and the size of the mammal or portion of the mammal that is to be protected. In these embodiments, some or all of the tensioned members or frames possess properties that cause the impact force to be reflected, deflected, and/or diverted away from the covered area. The frame must be rigid enough to support at least one tensioned member in an orientation and manner that will permit the tensioned member to reflect, deflect, and/or divert the impact energy away from the area of the mammal's body that is covered by the protective device, regardless of the angle of impact of the object with the protective device.

In one respect, the invention is a device for protecting a selected portion of a mammal's body, comprising a frame having a first portion and a second portion that is spaced apart from the first portion such that there is an empty volume located between the first portion and the second portion; wherein when the device is located such that the device is located in close proximity to the selected portion of the mammal's body and the second portion is located in front of the entire two-dimensional area of the selected portion of the mammal's body and an impact force that is equal to or greater than a threshold force is applied to the device, the first portion of the frame contacts the mammal's body at one or more points, all of the one or more points being located outside the two-dimensional area of the selected portion of the mammal's body.

In another respect, the invention is a device for protecting a selected portion of a mammal's body, the device comprising a frame having a first portion and a second portion that is spaced apart from the first portion such that there is an empty volume located between the first portion and the second portion; wherein when the device is located such that the device is located in close proximity to the selected portion of the mammal's body and the second portion is located in front of the entire two-dimensional area of the selected portion of the mammal's body and an impact force that is equal to or greater than a threshold force contacts the second portion of the frame, the second portion is deflected into the empty volume but does not come into contact with the selected portion of the mammal's body.

In yet another respect, the invention is a method for protecting a selected portion of a mammal's body from an impact force, the method comprising placing a device having a frame that includes a first portion and a second portion that is spaced apart from the first portion such that there is an empty volume located between the first portion and the second portion in close proximity to the selected portion of the mammal's body and such that the second portion is located in front of the entire two-dimensional area of the selected portion of the mammal's body, such that when an impact force that is equal to or greater than a threshold force contacts the frame, the first portion of the frame contacts the mammal's body at one or more points, all of the one or more points being located outside the two-dimensional area of the selection portion of the mammal's body. In additional respects, the method could further include the further steps of: shaping the frame so that a perimeter of the first portion is sized and shaped so as to surround the anterior and lateral cardiac silhouette of a human being; shaping the first portion so as to have a circular perimeter having a first radius and shaping the second portion so as to have a circular perimeter having a second radius, wherein the first radius is greater than the second radius; shaping a perimeter of the first portion so that it is non-circular; shaping a perimeter of the first portion so that it is non-circular and does not lie on a single plane; shaping a perimeter of the second portion so that it is non-circular; attaching or weaving one or more resilient members across the second portion that are deformable into an empty volume located between the first portion and the second portion; including one or more supplemental ribs connected to the frame of the device, optionally where a supplemental rib is intended to lie substantially parallel to an anterior axillary line of a human; and/or including a plurality of openings in a sidewall of the device that connects between the first portion and the second portion, the plurality of openings extending from an outer surface of the sidewall into an empty volume that is located between the first portion and the second portion.

DETAILED DESCRIPTION OF THE PREFERRED EMBODIMENTS

The ensuing detailed description provides preferred exemplary embodiments only, and is not intended to limit the scope, applicability, or configuration of the herein disclosed inventions. Rather, the ensuing detailed description of the preferred exemplary embodiments will provide those skilled in the art with an enabling description for implementing the preferred exemplary embodiments in accordance with the herein disclosed invention. It is understood that various changes may be made in the function and arrangement of elements without departing from the spirit and scope of the invention, as set forth in the appended claims.

To aid in describing the invention, directional terms may be used in the specification and claims to describe portions of the present invention (e.g., upper, lower, left, right, etc.). These directional definitions are merely intended to assist in describing and claiming the invention and are not intended to limit the invention in any way. In addition, reference numerals that are introduced in the specification in association with a drawing figure may be repeated in one or more subsequent figures without additional description in the specification, in order to provide context for other features.

For purposes of the specification and claims, the term "cardiac silhouette" means the superior area of skin located on the anterior (ventral), lateral, and/or posterior sides of a torso of a mammal that overlies the volume within the thorax in which the mammal's heart is located, regardless of the position of the mammal's torso, head, or limb(s).

For purposes of defining relative locations of objects in the specification and claims, the phrase "in front of" means that said object is located between a reference object or surface and a point located exterior to the reference object or surface; in other words, located before a reference object or surface so that it "covers" the reference object or surface, regardless of whether reference is to an anterior, posterior, or other surface of an object. For example, when referring to an object located "in front of" the anterior side of a human body, the object is located anterior to the anterior side of the human body.

For purposes of the specification and claims, a first object is to be considered to be "in close proximity to" a second object when the two objects are located no more than 2.00 inches (5.08 centimeters) apart.

For purposes of the specification and claims, two lines or surfaces are considered to be "substantially parallel" to another when an absolute value of the measurement of the angle between the two lines or surfaces does not exceed 15 degrees.

For purposes of the specification and claims, a surface, opening, part, assembly, or portion thereof is to be considered "substantially planar" or lying "substantially in a plane" when at least 90% of the area thereof lies in a single plane.

Referring generally to FIGS. 1-9, several embodiments of a protective device for protecting a portion of a mammal's body from an impact force will be described in detail. FIG. 1 shows a first embodiment of a protective device 10 that includes a frame 12 having a sidewall 14 that connects between and spaces apart a lower frame portion 20 and an upper frame portion 30. In this embodiment, the sidewall 14 of the frame 12 has a plurality of openings (openings 16*a*,16*b* labeled in FIG. 1) that extend between a radially outer surface 17 of the sidewall 14 and a radially inner surface 18 of the sidewall 14. In this embodiment, the openings 16*a*,16*b* have an oval cross-sectional shape. It should be understood that multiple alternate cross-sectional shapes for the openings 16*a*,16*b* are possible within the scope of this invention, including circular, triangular, square, and rectangular. In alternate embodiments, the openings 16*a*,16*b* may be omitted entirely from the frame 12.

Figure 2:
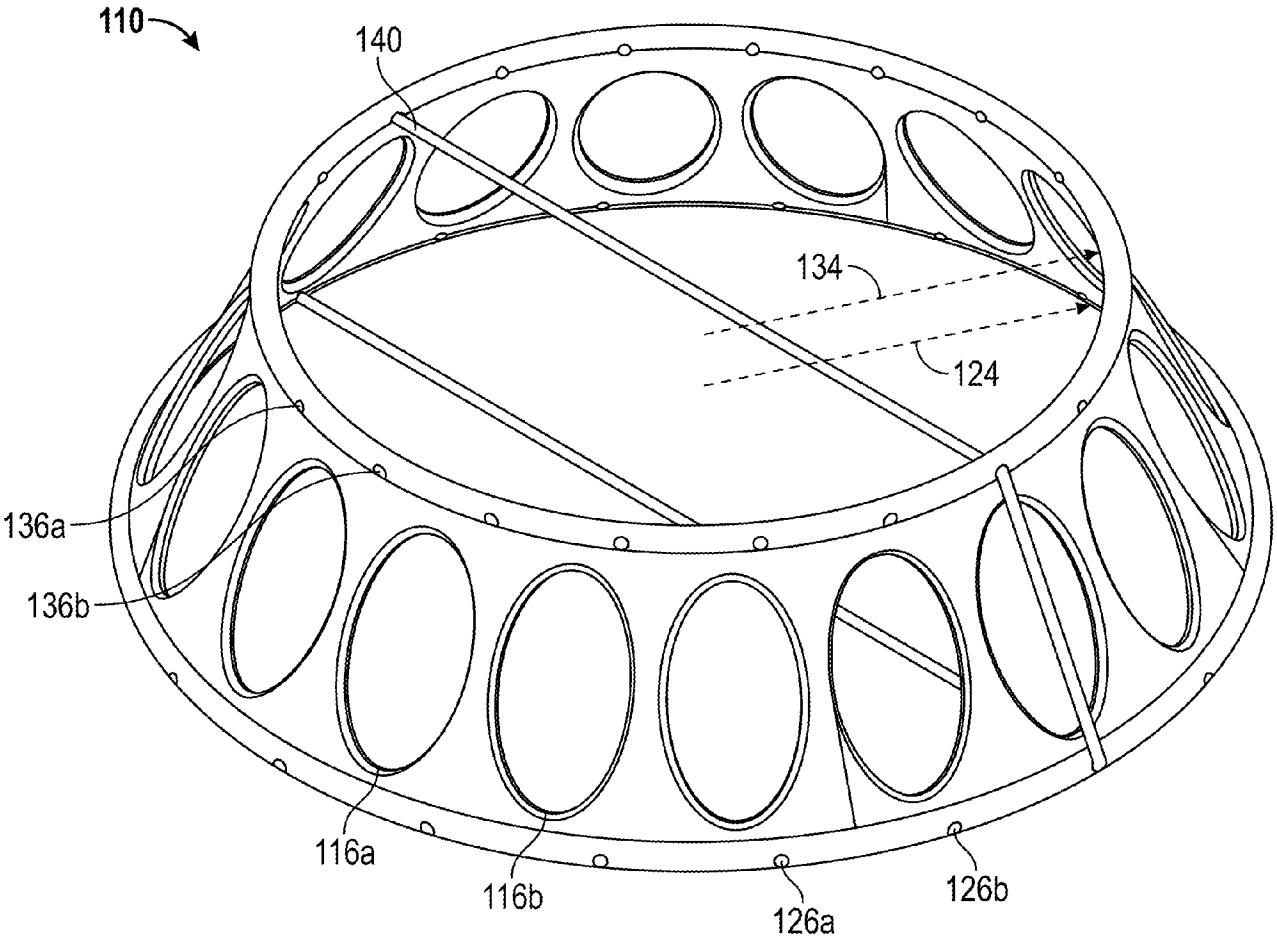
FIG. 2 is a perspective view of a second embodiment of a device according to the present invention, in a partially-wound configuration.

In this embodiment, the lower frame portion 20 has a perimeter 22 that is circular in shape such that the lower frame portion 20 has a radius (see FIG. 2, reference numeral 124), and the upper frame portion 30 has a perimeter 32 that is circular in shape such that the upper frame portion 30 has a radius (see FIG. 2, reference numeral 134). In this embodiment, the radius of the lower frame portion 20 is greater than the radius of the upper frame portion 30, such that the frame 12 has the approximate shape of a truncated cone with open top and bottom sides. In alternate embodiments, the lower frame portion 20 and/or upper frame portion 30 need not have circular perimeters(s).

In this embodiment, the frame 12 has one or more tensioned or resilient members 40 that are mounted to the upper frame portion 30 at a plurality of mounting holes (mounting holes 36*a*,36*b* labeled in FIG. 1) that are located along the perimeter 32 of the upper frame portion 30. The one or more resilient members 40 form a plurality of passes (passes 42*a*, 42*b* labeled in FIG. 1) that are interwoven or arranged so as to form a resilient layer 44. In this embodiment, multiple resilient members are used, though it should be understood that in alternate embodiments, a single resilient member may form the plurality of passes. In this embodiment, when not subject to any external forces, the resilient layer 44 lies substantially in a plane 45.

The one or more resilient members 40 are selected to have sufficient properties, such as elasticity, tensile strength, rupture resistance, hardness, and energy absorbance, such that when an impact energy having a value that is equal to or greater than a minimum amount (hereinafter referred to as a "threshold force") that is required to move the frame 12 into contact with the mammal's body around the area of the selected portion of the body to be protected is applied to the device 10, the resilient layer 44 and/or frame 12 reflects, deflects, and/or otherwise diverts the impact energy that was applied to the device 10 either away from the mammal's body or to one or more points located on the mammal's body that are located outside the area of the selected portion. As discussed in further detail below, if the device 10 were located in front of all or a portion of the cardiac silhouette 4 of a person (see FIGS. 10 and 11), if an impact force equal to or greater than the threshold force were applied to the device 10, the device 10 would likely reflect a portion of the impact energy and transfer the remaining portion of the impact energy through the lower frame portion 20 to one or more points on the person's body that are located exterior to the area of the cardiac silhouette 4. In a preferred embodiment, the materials of the frame 12 and the resilient layer 44 are selected and arranged so as to reflect at least 25%, and more preferably between 50-100% of the force-applying object's energy outwards, e.g., away from the user's body, such as in a direction substantially opposite to the force-applying object's approach.

The frame 12 can be made of any suitable rigid material that can be strung, wound, or draped with one or more resilient members 40. For example, the frame 12 or parts thereof (e.g., lower frame portion 20, upper frame portion 30, and/or sidewall 14) can be comprised of any suitable metal, alloy, composite, plastic, wood, or combinations thereof. A "composite," as used herein, means any composite material, such as fiberglass, carbon fiber, polyaramid fibers, fibers, powders, resins, ceramics, and other materials that can be formed into a suitably rigid frame or frame portion, while also having desirable properties such as suitable vibration and energy absorption, strength-to-weight ratio, and commercially-acceptable cost of manufacturing. Likewise, the one or more resilient member 40 can be comprised of any suitable plastic, metal, rubber or rubber-like material, composite, natural and/or synthetics fiber or polymer (e.g., nylon) or combinations thereof In the embodiment of FIG. 1, an empty volume 60 is bounded by the lower frame portion 20, upper frame portion 30, and radially inner surface 18 of the sidewall 14. This empty volume 60 can accommodate movement of the resilient layer 44 towards the user's body without permitting either the resilient layer 44 or the force-applying object (e.g., a projectile) from making contact with the user's body inside the perimeter 22 of the lower frame portion 20. Thus, if a portion of the impact energy is not reflected by the device 10 away from the user's body, this non-reflected portion of the impact energy will be diverted around the selected portion of the user's body.

Figure 3:
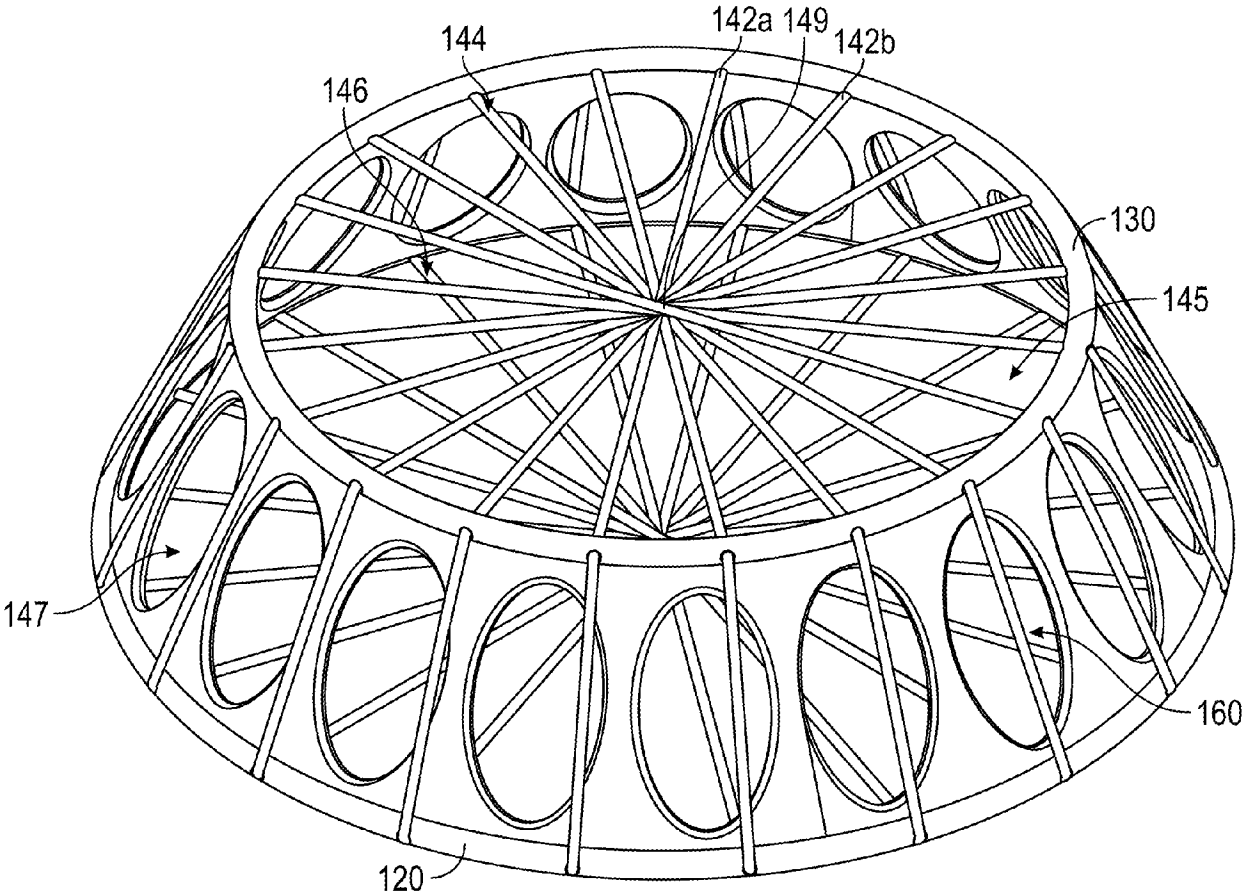
FIG. 3 is a perspective view thereof, showing a first exemplary winding pattern for the resilient material.
Figure 4:
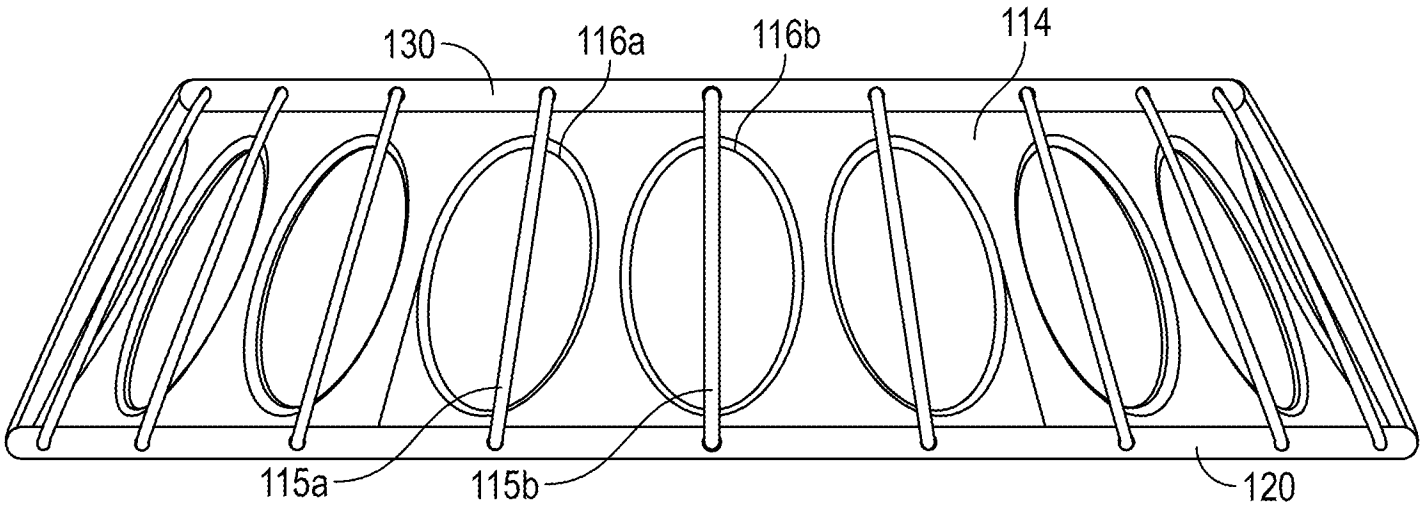
FIG. 4 is a side view thereof.

FIGS. 2-4 depict a second embodiment of a protective device 110 in accordance with the present inventive concept. In this embodiment, elements shared with the first embodiment (protective device 10) are represented by reference numerals increased by a value of 100. For example, the upper frame portion 30 in FIG. 1 corresponds to the upper frame portion 130 in FIGS. 2-4. In the interest of brevity, some features of this embodiment that are shared with the first embodiment are numbered in FIGS. 2-4, but are not discussed in the specification.

In this embodiment, the protective device 110 has a lower frame portion 120 and an upper frame portion 130. As opposed to the embodiment of FIG. 1, the lower frame portion 120 of this embodiment also has a plurality of mounting holes (mounting holes 126*a*,126*b* labeled in FIG. 2) that are located along the perimeter 122 of the lower frame portion 120. The one or more resilient members 140 form a lower resilient layer 146 that is formed within the lower frame portion 120 that is in addition to the upper resilient layer 144 that is formed within the upper frame portion 130. In this embodiment, when not subject to any external forces, the upper resilient layer 144 lies substantially in a first plane 145 and the lower resilient layer 146 lies substantially in a second plane 147. Otherwise, the embodiment of FIGS. 2-4 is substantially identical to the embodiment of FIG. 1.

In the embodiment of FIGS. 2-4, additional passes of the one or more resilient member 140 extend between respective mounting holes located on the lower frame portion 120 and the upper frame portion 130 so that at least one sidewall pass (sidewall passes 115*a*,115*b* labeled in FIG. 4) extends over the radially outward surface of each of the openings (openings 116*a*,116*b* labeled in FIG. 4) located in the sidewall 114 of the frame 112. In alternate embodiments, the sidewall passes may be omitted entirely, placed over the radially outward surface of only some of the openings located in the sidewall, or placed over the radially inward surface of some or all of the openings located in the sidewall. In alternate embodiments where the openings are omitted from the sidewall of the frame entirely, the sidewall passes 115*a*,115*b* may run over the radially outward surface of the solid sidewall.

Figure 5:
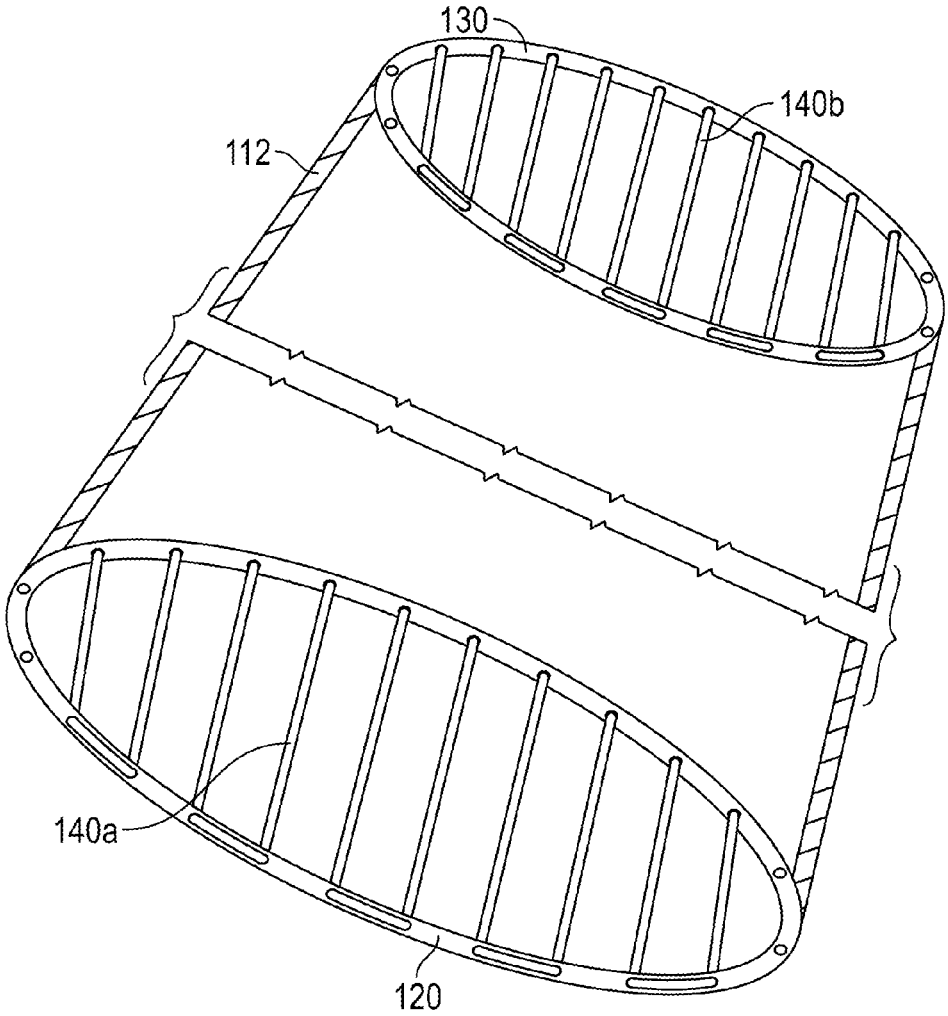
FIGS. 5-8 show exemplary winding patterns for the resilient material for any embodiment of the device.
Figure 6:
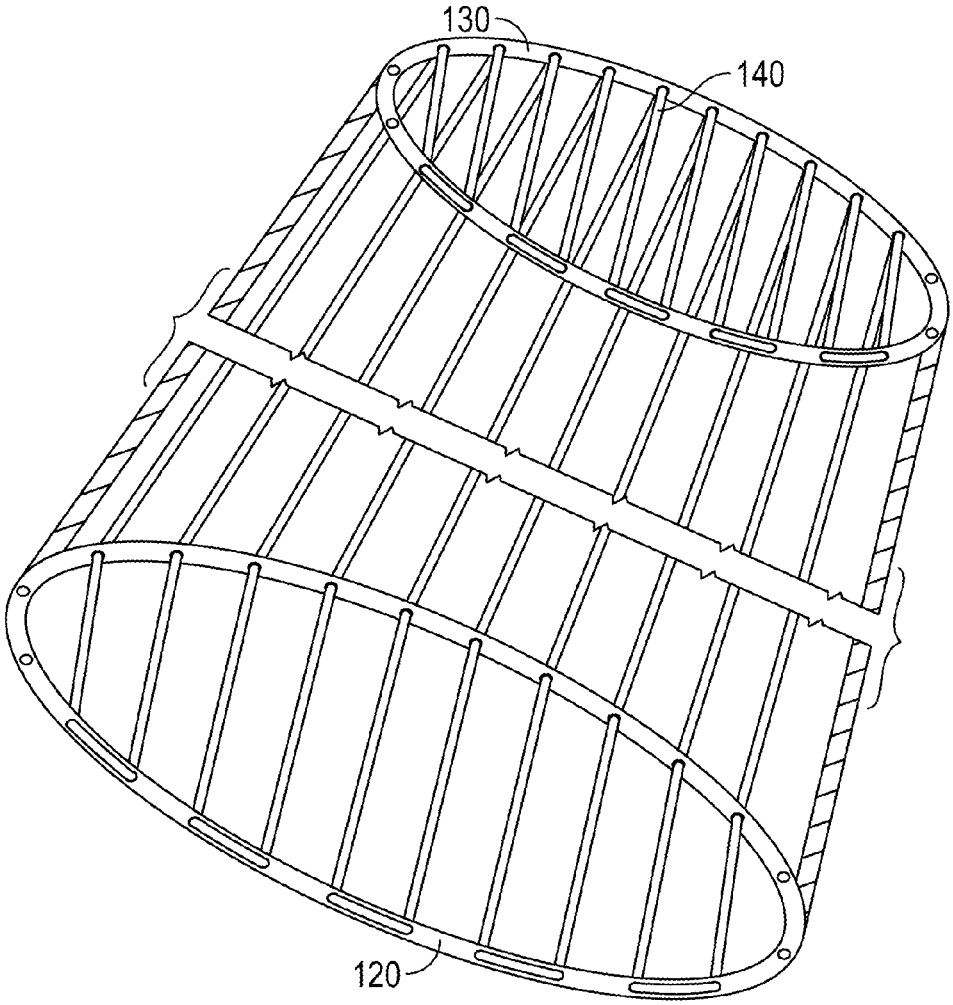
Figure 7:
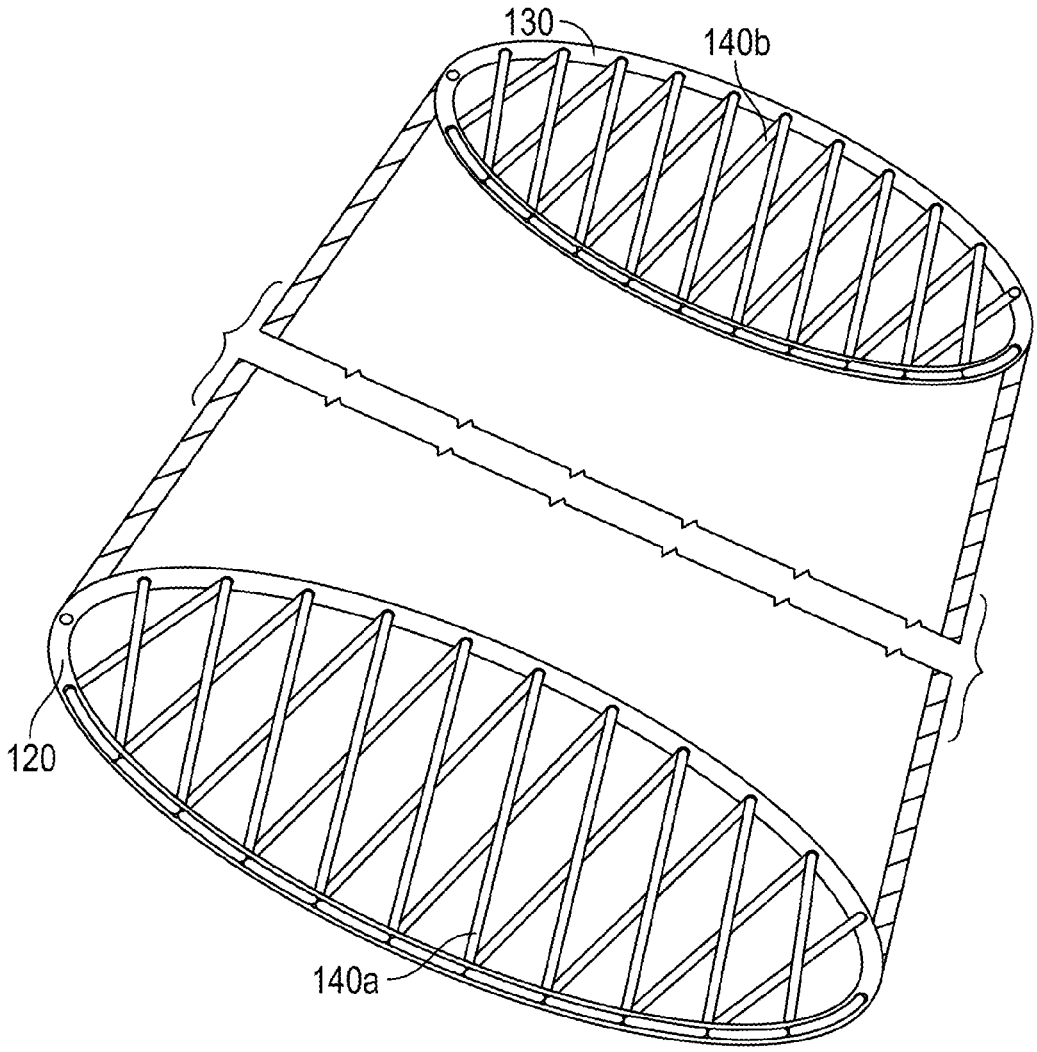
Figure 8:
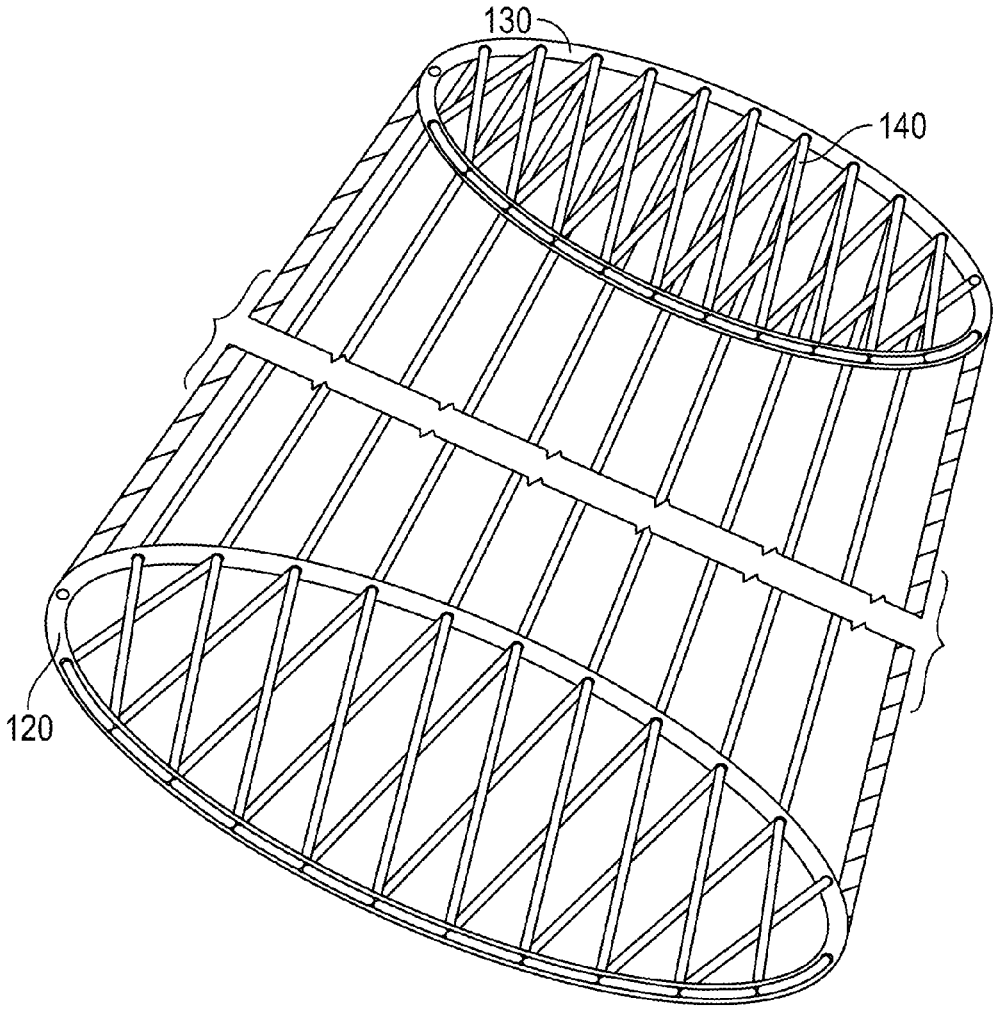

FIGS. 5-8 show exemplary cutaway views of different patterns by which one or more resilient members may be woven onto a frame 112. It should be understood that these features are applicable to any embodiment of the protective device discussed in this application, mutatis mutandis. FIGS. 5-8 are not drawn to scale but are shown with the upper frame portion 130 and lower frame portion 120 shown spread apart so as to ease viewing of the winding patterns used therein. In the embodiment of FIG. 5, a first resilient member 140*a* is woven in parallel passes across the lower frame portion 120 and a second resilient member 140*b* is woven in parallel passes across the upper frame portion 130. In the embodiment of FIG. 6, a single resilient member 140 is woven in parallel passes across both the lower frame portion 120 and the upper frame portion 130. In the embodiment of FIG. 7, a first resilient member 140*a* is woven in a zig-zag (diagonal) pattern across the lower frame portion 120 and a second resilient member 140*b* is woven in a zig-zag (diagonal) pattern across the upper frame portion 130. Referring again to the embodiment of FIG. 1, the one or more resilient member 40 is shown woven in an open (fenestrated) square weave pattern (similar to the weaving pattern common to many tennis racquets) across the upper frame portion 30. In alternate embodiments, the one or more resilient member 40 could form a non-fenestrated square weave pattern. Referring again to the embodiment of FIGS. 2-4, the one or more resilient member 140 is woven in a centerpoint pattern (wherein each pass of the one or more resilient member 140 is routed through a centerpoint 149 of the upper frame portion 130). It should be understood that many other passing patterns for the one or more resilient member is possible within the scope of this invention, and that lower and upper frame portions within a single protective device could employ different passing patterns.

In embodiments where a single resilient member is wound between both upper 130 and lower 120 frame portions, when a force-applying object (e.g., a projectile) strikes the upper resilient layer 144, the deflection of each pass that is contacted by the force-applying object causes a deformation of and an increase in the tension of the upper resilient layer 144, thereby resulting in an additional increase in the tension of the lower resilient layer 146. This increase in the tension of the lower resilient layer 146 has a two-fold effect; 1) it guarantees that the force-applying object will not be able to deflect the upper resilient layer 144 far enough into the empty volume 160 that it will contact that portion of the user's body located interior to the perimeter 122 of the lower frame portion 120 (i.e., located behind the lower resilient layer 146); and 2) it momentarily stores the impact energy that was transferred by the force-applying object to the upper resilient layer 144, then transfers that energy back to the upper resilient layer 144 in order to propel the force-applying object (e.g., projectile) away from the user, while also resulting in a springing of the lower resilient layer 146 away from the body.

In the embodiments disclosed in this application, when the one or more resilient member of the one or more resilient layer has suitable elastic properties, a reduced amount of force is transmitted to the frame of the protective device, and therefore a reduced amount of force is exerted from the lower frame portion to the user. In any case, the energy that is transferred to the frame will either be absorbed by partial, temporary deformation of the sidewall of the frame (potentially aided by the openings) or diverted to the lower frame portion so that the remaining force is transferred to the user's body at one or more points that are located entirely external to the area internal to the perimeter of the lower frame portion (i.e., external to the area of the selected portion of the user's body that is to be protected).

Figure 9:
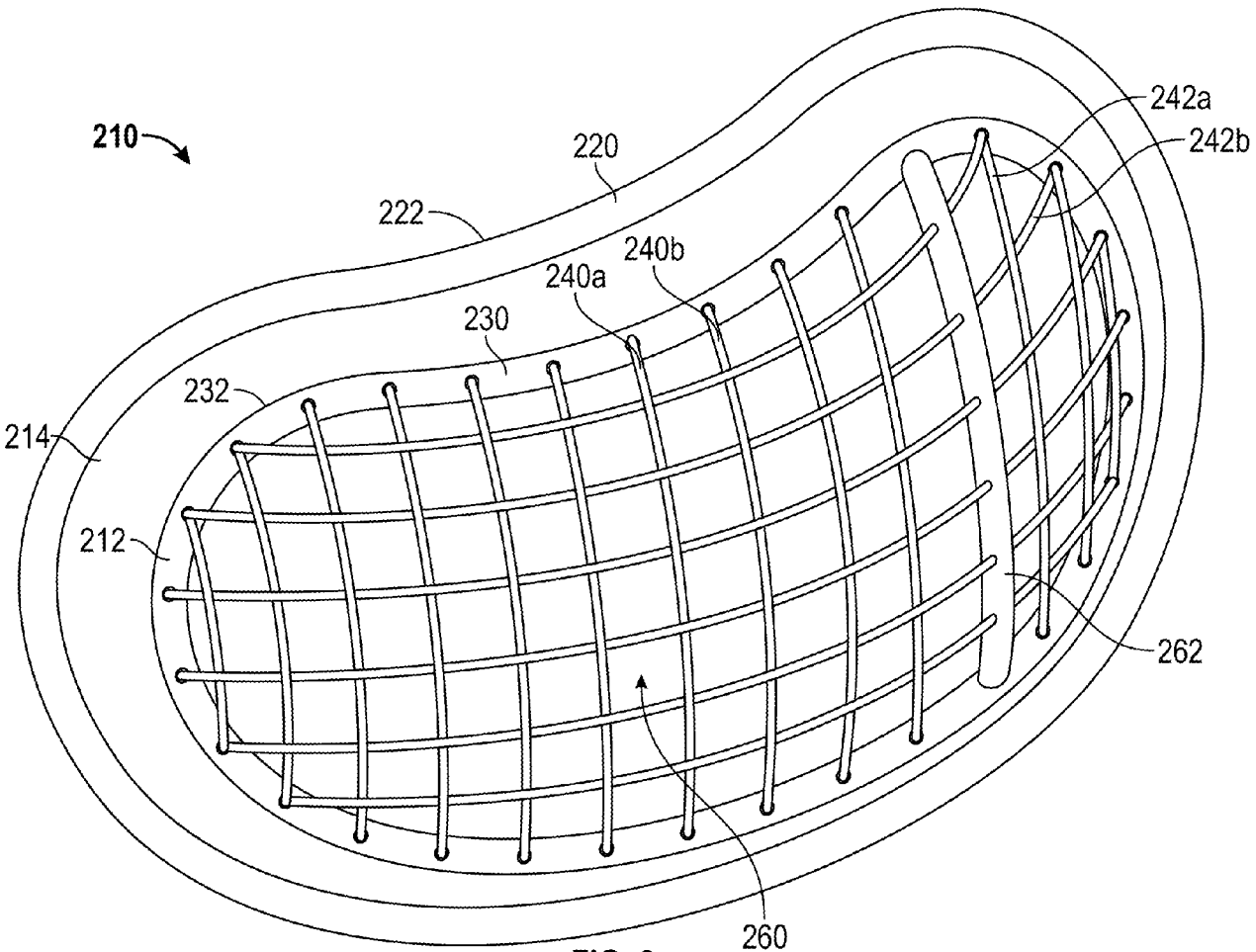
FIG. 9 is a perspective view of a third embodiment of a device according to the present invention.

Referring now to FIG. 9, a third embodiment of a protective device 210 in accordance with the present inventive concept is shown. In this embodiment, elements shared with the first embodiment (protective device 10) are represented by reference numerals increased by a value of 200. For example, the lower frame portion 20 in FIG. 1 corresponds to the lower frame portion 220 in FIG. 9. In the interest of brevity, some features of this embodiment that are shared with the first embodiment are numbered in FIG. 9, but are not discussed in the specification.

In this embodiment, both the lower frame portion 220 and the upper frame portion 230 have non-circular perimeters 222,232 that do not lie in a single plane, and the perimeter 222 of the lower frame portion 220 surrounds a greater two-dimensional area than does the perimeter 232 of the upper frame portion 230. In alternate embodiments, the two perimeters 222,232 may surround two-dimensional areas of the same size. In this embodiment of FIG. 9, the sidewall 214 that extends between the lower frame portion 220 and the upper frame portion 230 is solid and does not include openings. In alternate embodiments, the sidewall 214 may have one or more openings located in it, as discussed above with respect to the first embodiment of the device. In this embodiment, the frame 212 is shaped so as to be in front of both the anterior and lateral portions of the cardiac silhouette (see FIG. 11, reference numeral 4), i.e., by being shaped so as to follow the lateral contour of the chest wall of a user's torso. In this embodiment, the device 210 also includes a supplemental strut or rib 262 that is intended to be placed substantially parallel with the anterior axillary line (see FIG. 11, reference numeral 8) of the user. The one or more resilient members (resilient members 240*a*,240*b* labeled in FIG. 9) are woven across or through the supplemental rib 262, and both the resilient members 240*a*,240*b* and the supplemental rib 262 provide additional protection for lateral impacts to the cardiac silhouette 4 of the user. In this embodiment, the resilient members 240*a*,240*b* do not lie substantially in a single plane. In alternate embodiments, the supplemental rib 262 may be omitted.

Figure 10:
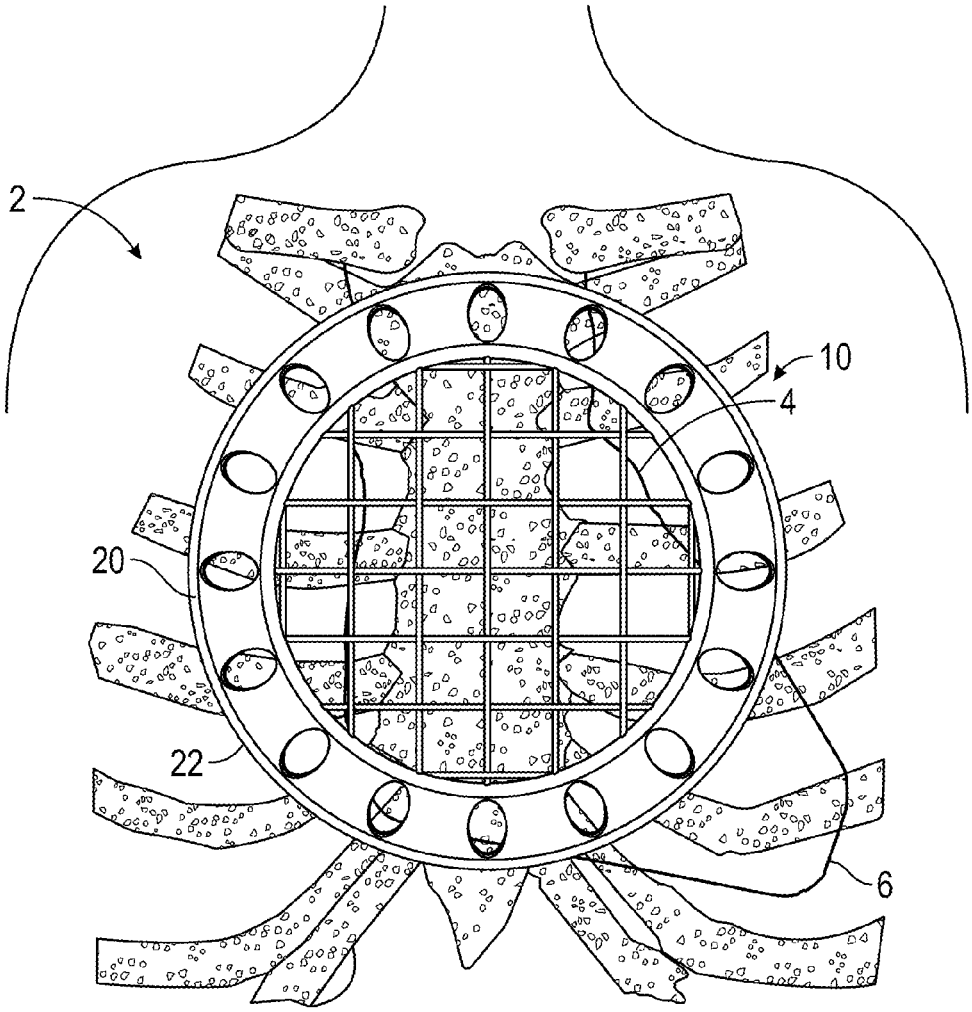
FIG. 10 is a schematic view of the device of FIG. 1 located in front of the anterior cardiac silhouette of an exemplary torso.
Figure 11:
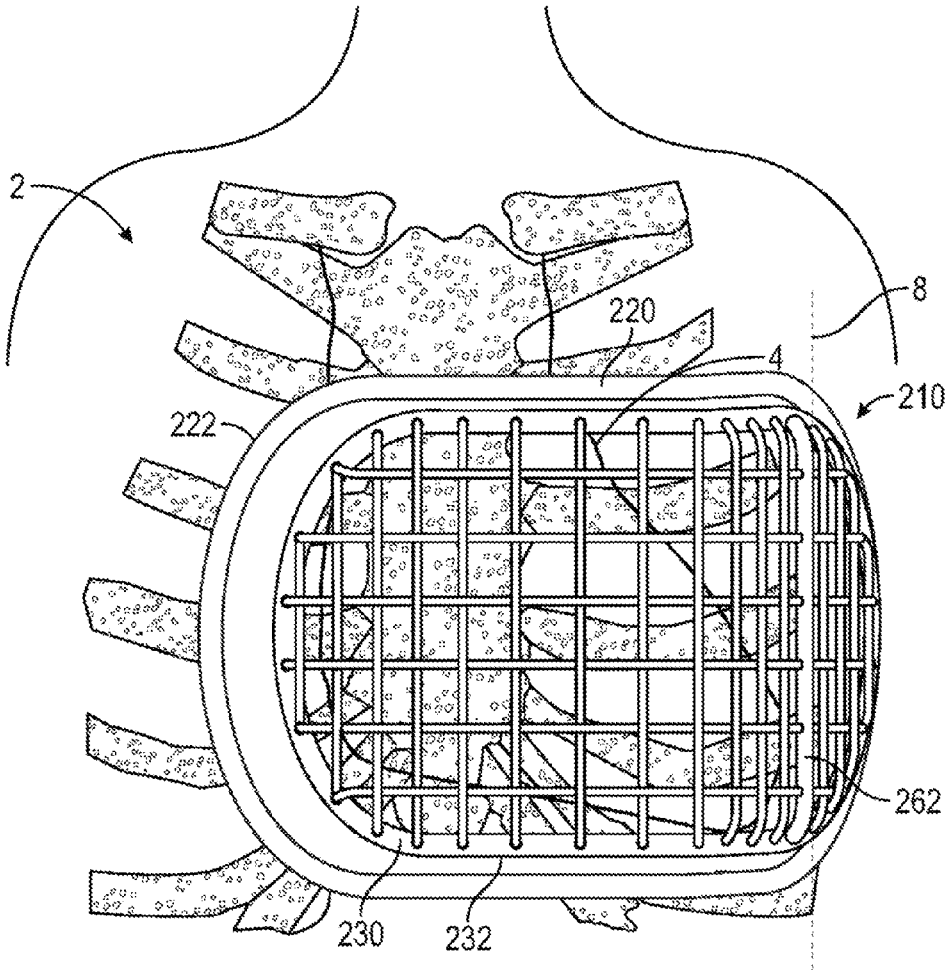
FIG. 11 is a schematic view of the device of FIG. 9 located in front of the anterior and lateral cardiac silhouette of an exemplary torso, following the lateral contour of the chest wall.

FIG. 10 shows the protective device 10 of FIG. 1 in front of a majority of the cardiac silhouette 4 of an exemplary torso 2 of a person. In this example, unless the protective device 10 is sized larger, it may not be located in front of the apex 6 of the heart of the person, such that it may not protect from some lateral impact forces. In FIG. 11, the protective device 210 of FIG. 9 is shown in front of the cardiac silhouette 4 of an exemplary torso 2 of a person. Giving the protective device 210 a curved shape that partially conforms to the lateral contour of the user's torso 2 and includes additional protection along the anterior axillary line 8 permits the protective device 210 to be given a minimal size while still being locatable in front of the entire cardiac silhouette 4.

Any embodiment of the device 10,110,210 disclosed herein may be mounted to a user by any known means. For example, the device 10,110,210 could be attached and held in place by straps, belts, connectors, or the like that are wrapped around the user's torso or other relevant body part. Alternatively, the device may be placed into a pocket or pouch located inside or adherent to a chest protector, vest, shoulder pads, or tight-fitting article of clothing (such as a compression shirt). Due to the shifting of activewear and pads during athletic activities, in some cases the device 10, 110,210 may not be in direct contact with the selected portion of the mammal's body at the time that an impact force initially contacts the device 10,110,210. As noted above, the "threshold force" is the minimum force necessary in these cases to move the device 10,110,210 into contact with the mammal's body.

Preferably, but optionally, any embodiment of the device taught herein can further include cushioning, such as energy-absorbing foams and other known cushion materials, located on the body-facing side of the lower frame portion to cushion the user from uncomfortable contact with the protective device. Additionally, or alternatively, one or more of the resilient members can be optionally coated, covered, or selected in order to be soft to the touch, but without diminishing their reflective and other desirable protective properties. Additionally, or alternatively, additional cushion or other energy and/or vibration-dampening or absorbing materials can optionally be included in, among, or between resilient layer(s) of the device so as to provide any desirable property identified herein.

It should be appreciated that the foregoing is presented by way of illustration only, and not by way of any limitation, and that various alternatives and modifications may be made to the illustrated embodiments without departing from the spirit and scope of the present invention.

The invention claimed is:

1. A device for protecting a selected portion of a mammal's body, the device comprising:

a frame having a first portion and a second portion that is spaced apart from the first portion such that there is an empty volume located between the first portion and the second portion;

wherein when the device is located such that the device is located in close proximity to the selected portion of the mammal's body and the second portion is located in front of the entire two-dimensional area of the selected portion of the mammal's body and an impact force that is equal to or greater than a threshold force is applied to the device, the first portion of the frame contacts the mammal's body at one or more points, all of the one or more points being located outside the two-dimensional area of the selected portion of the mammal's body; and wherein the second portion comprises one or more resilient members that are woven across the frame.

2. The device of claim 1, wherein the first portion has a perimeter that is shaped and sized so as to surround the cardiac silhouette of the mammal's body.

3. The device of claim 1, wherein the first portion comprises a circular perimeter including a first radius.

4. The device of claim 3, wherein the second portion comprises a circular perimeter including a second radius.

5. The device of claim 4, wherein the first portion includes a first frame portion having the first radius and the second portion comprises a second frame portion having the second radius, wherein the first radius is greater than the second radius.

6. The device of claim 1, wherein the first portion comprises a non-circular perimeter.

7. The device of claim 6, wherein the non-circular perimeter does not lie in a single plane.

8. The device of claim 6, wherein the second portion comprises a non-circular perimeter.

9. The device of claim 1, wherein the one or more resilient members deform into the empty volume when impacted by the impact force.

10. The device of claim 1, wherein the one or more resilient members lie substantially in a plane when not being impacted by the impact force.

11. The device of claim 1, wherein the one or more resilient members are woven across the frame in a fenestrated box weave pattern.

12. The device of claim 1, further comprising one or more supplementary struts or ribs connected to the frame, across or through which the one or more resilient members are woven.

13. The device of claim 1, wherein the second portion is spaced apart from the first portion by at least one sidewall.

14. The device of claim 13, wherein the at least one sidewall has a plurality of openings located through it, the plurality of openings extending from an outer surface of the at least one sidewall into the empty volume.

15. A device for protecting a selected portion of a mammal's body, the device comprising:

a frame having a first portion and a second portion that is spaced apart from the first portion such that there is an empty volume located between the first portion and the second portion;

wherein when the device is located such that the device is located in close proximity to the selected portion of the mammal's body and the second portion is located in front of the entire two-dimensional area of the selected portion of the mammal's body and an impact force that is equal to or greater than a threshold force contacts the second portion of the frame, the second portion is deflected into the empty volume but does not come into contact with the selected portion of the mammal's body; and wherein the second portion comprises one or more resilient members that are woven across the frame.

16. The device of claim 15, wherein the first portion includes a first frame portion having a first radius and the second portion includes a second frame portion having a second radius, wherein the first radius is greater than the second radius.

17. The device of claim 15, wherein the first portion comprises a non-circular perimeter.

18. The device of claim 15, wherein the one or more resilient members are woven across the frame in a fenestrated box weave pattern.

19. A method for protecting a selected portion of a mammal's body from an impact force, the method comprising:

placing a device having a frame that includes a first portion and a second portion that is spaced apart from the first portion such that there is an empty volume located between the first portion and the second portion in close proximity to the selected portion of the mammal's body and such that the second portion is located in front of the entire two-dimensional area of the selected portion of the mammal's body, such that when an impact force that is equal to or greater than a threshold force contacts the frame, the first portion of the frame contacts the mammal's body at one or more points, all of the one or more points being located outside the two-dimensional area of the selected portion of the mammal's body; wherein the second portion comprises one or more resilient members that are woven across the frame.

20. The method of claim 19, wherein the step of placing the device in close proximity to the selected portion of the mammal's body further comprises providing the second portion of the device with the one or more resilient members being woven across the frame in a fenestrated box weave pattern.

* * * * *